United States Patent [19]

Willis et al.

[11] 4,366,606

[45] Jan. 4, 1983

[54] SELF-CENTERING CLAMP FOR DOWN-HOLE TUBULARS

[75] Inventors: Clyde A. Willis; Jerry K. Lingafelter, both of Wichita Falls, Tex.

[73] Assignee: Walker-Neer Mfg. Co., Inc., Wichita Falls, Tex.

[21] Appl. No.: 182,771

[22] Filed: Aug. 29, 1980

[51] Int. Cl.[3] ..... A44B 21/00

[52] U.S. Cl. ..... 24/263 DA; 269/218

[58] Field of Search ..... 24/263 R, 263 D, 263 DA; 269/218, 238; 74/110

[56] References Cited

U.S. PATENT DOCUMENTS

| | | | |
|---|---|---|---|
| 383,334 | 5/1888 | Wrench | 24/263 R |
| 3,386,726 | 6/1968 | Lorene | 269/32 |
| 3,389,613 | 6/1968 | Turnbull | 74/110 |
| 3,961,399 | 6/1976 | Boyadjieff | 24/263 DA |

*Primary Examiner*—Gene Mancene
*Assistant Examiner*—John Weiss
*Attorney, Agent, or Firm*—Hume, Clement, Brinks, Willian & Olds, Ltd.

[57] ABSTRACT

An automatically self-centering clamp for down-hole tubulars includes a frame which defines guides for two opposed clamping jaws. Each clamping jaw is pivotably attached to a rocker arm, and the two rocker arms are in turn pivotably attached to a tension member which extends therebetween. The tension member is mounted to the frame so as to be free to move in the direction of the clamping axis of the clamp as necessary to follow the movement of the jaws. A hydraulic cylinder is provided to pivot the rocker arms about the tension member, thereby positioning the jaws in the guides formed by the frame. A rotatable pivot plate is mounted to rotate within the frame, and link members are provided to link each of the rocker arms with a respective point on the pivot plate. The link members and the pivot plate act to maintain the rocker arms in symmetrical positions such that the jaws remain centered about a predetermined clamping axis for a wide range travel of the jaws.

14 Claims, 5 Drawing Figures

SELF-CENTERING CLAMP FOR DOWN-HOLE TUBULARS

BACKGROUND OF THE INVENTION

The present invention relates to a device for clamping oil well and water well tubulars and rods, including but not limited to drill pipe, drill collars, well casing, production tubing, sucker rods, pump column pipe, and the like, all of which tubulars, pipes and rods are referred to herein simply as "down-hole tubulars". More particularly, this invention relates to such a clamp which precisely centers down-hole tubulars of varying diameters.

In well drilling and well completion operations it is often necessary to lift and to align lengths of down-hole tubulars precisely. For example, in oil or water well drilling, multiple lengths of drill pipe must often be raised from a horizontal position at or near ground level to a vertical position aligned with the center line of the well. Such lifting and aligning operations require some type of clamp for securely holding the tubular in place as it is lifted. When a pivotably mounted transfer arm is used, this clamp must support large loads in several different orientations.

Compounding the problem is the fact that each joint or length of down-hole tubular must be closely aligned with a string of such tubulars after it has been lifted to the vertical position, as when a string of drill pipe or casing is being made up, for example. A clamp for such purposes should preferably provide, without any adjustment, the necessary alignment for down-hole tubulars having various diameters. Proper alignment has been a problem for many such clamps of the prior art, particularly those employing pivoted clamping jaws.

When pivoted clamping jaws are used, there is a tendency for the center of the clamped down-hole tubular to vary as a function of the diameter of the tubular being clamped. This problem may be alleviated somewhat by using guided jaws in conjunction with symmetrically moving pivoted rocker arms. Such an arrangement is shown in a machine tool clamp described by Lorenz in U.S. Pat. No. 3,386,726. In the Lorenz clamp the guided jaws are free to translate with respect to the pivotably mounted rocker arms as the clamp closes.

This approach, however, suffers from the disadvantage that loads are not symmetrically distributed in the clamp for the full range of clamp positions. As the guided jaw translates with respect to the rocker arm, the center of clamping force on the jaw moves.

SUMMARY OF THE INVENTION

The present invention is directed to a self-centering clamp for down-hole tubulars which avoids these and other disadvantages of the prior art.

The general object of this invention is to provide a clamp for down-hole tubulars which precisely clamps and centers such tubulars in such a manner that in each case the tubular is clamped with its central axis at a substantially constant position with respect to the clamp, in spite of variations in the diameter of the clamped tubular.

Another object of this invention is to provide a sturdy clamp which symmetrically bears the clamping forces associated with clamping and holding down-hole tubulars having a range of diameters.

Yet another object of this invention is to provide a clamp having the aforementioned self-centering and symmetrical load bearing features which can clamp down-hole tubulars having a predetermined range of diameters without requiring manual adjustment or replacement of component parts, thereby speeding and facilitating both drilling and well service operations.

Yet another object of this invention is to provide a clamp having the aforementioned self-centering and symmetrical load bearing features which is compact and avoids complex positioning linkages such that the clamp can be rotatably mounted to a transfer arm, thereby facilitating gravity loading and unloading of the clamp, as well as the use of automated or semi-automated loading and unloading systems.

According to this invention, these and other objects are achieved by providing a clamp having two opposed clamping members which are guided along a first line which passes through the clamping axis. Means are provided for positioning the opposed clamping members along the first line such that the clamping members are maintained substantially equidistant from the clamping axis. Preferably this interconnecting means comprises a pivot member having first and second spaced attachment points, means for pivotably mounting the pivot member to the clamp, means for connecting the first clamping member to the first attachment point such that movement of the first clamping member along the first line causes the pivot member to rotate, and means for connecting the second clamping member to the second attachment point such that rotation of the pivot member causes the second clamping member to move along the first line to maintain the first and second clamping members substantially equidistant from the clamping axis.

In that both clamping members are guided along a line which passes through the clamping axis, the clamp of this invention provides substantially symmetrical load bearing capabilities for down-hole tubulars having a wide range of diameters. This facilitates the design of a clamp which is sturdy yet not unduly heavy due to the need to withstand assymetrical clamping loads.

Another advantage of this invention is that down-hole tubulars of varying diameters can be accurately clamped and centered about the same clamping axis. This facilitates precise alignment of the clamped length of down-hole tubular with other lengths, such as in a drill string or a production string, for example.

The clamp of this invention provides the further advantage that the clamp itself can be embodied in a sturdy, compact structure which avoids the need for gear mechanisms, which may be subject to failure under adverse conditions of field use. In addition, the clamp of this invention provides the further advantage that no manual adjustment or replacement of parts is required to obtain the precise centering and symmetrical clamping features described above, even when down-hole tubulars of varying diameters are clamped.

These and other objects and attendant advantages of the present invention will be better understood by reference to the following detailed description taken in connection with the accompanying drawings.

DETAILED DESCRIPTION OF A PREFERRED EMBODIMENT

Figure 1:
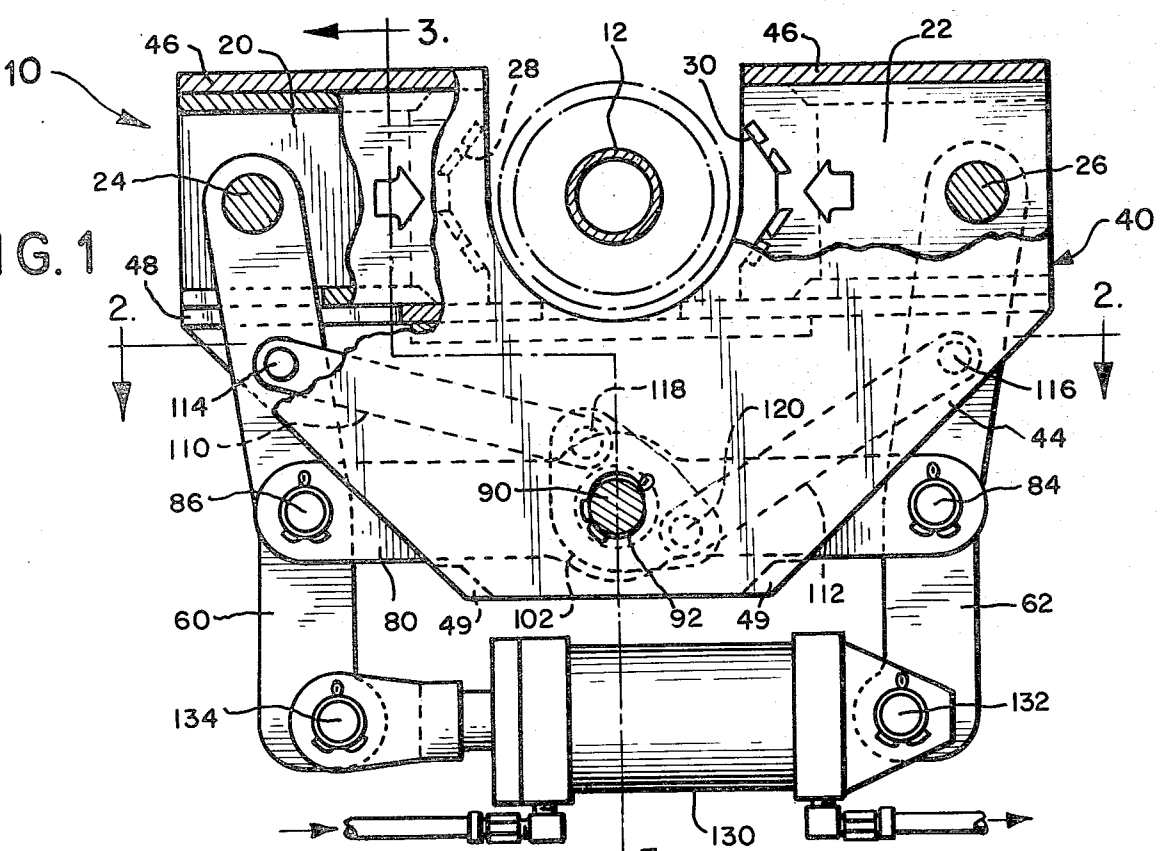
FIG. 1 is a side view in partial cutaway of a preferred embodiment of the self-centering clamp of this invention .

Referring now to the drawings, FIG. 1 shows a side view of a preferred embodiment of the self-centering clamp of this invention. This clamp 10 is provided with a frame 40 which forms the basic structure of the clamp 10. This frame 40 is a weldment made up of a number of component plates, including opposed parallel side plates 42,44 which are separated by opposed parallel edge plates 46,48. In addition, brace plates 49 are provided to further strengthen the frame 40 and to maintain the side plates 42,44 in a parallel relationship.

Figure 3:
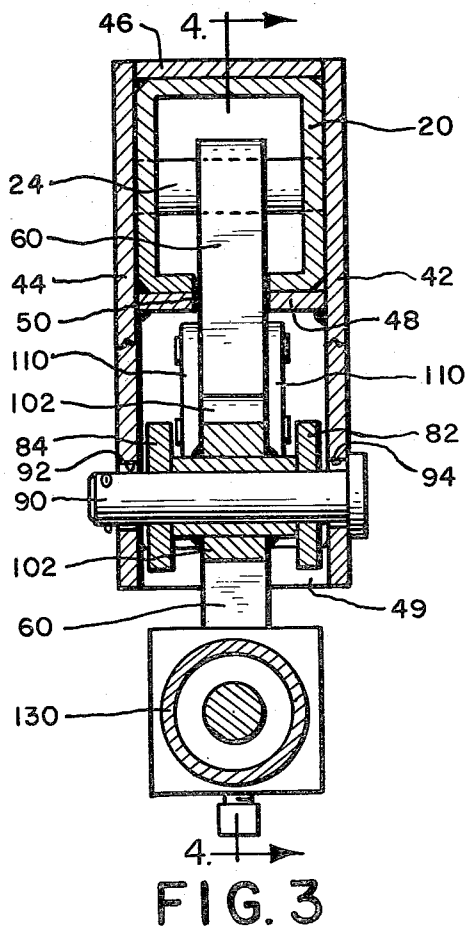
FIG. 3 is a cross-sectional view taken along line 3—3 of FIG. 1.

As best shown in FIG. 3, the side plates 42,44 and the edge plates 46,48 cooperate to form a rigid boxlike structure at one end of the clamp 10. This boxlike structure guides the movement of the opposed jaws 20,22, as will be explained in detail below. The frame 40 forms the main structure of the clamp 10 and in this preferred embodiment is welded up from component plates of steel which are for the most part one-half inch in thickness. The edge plates 46,48 are preferably $\frac{3}{4}$ of an inch in thickness.

Figure 4A:
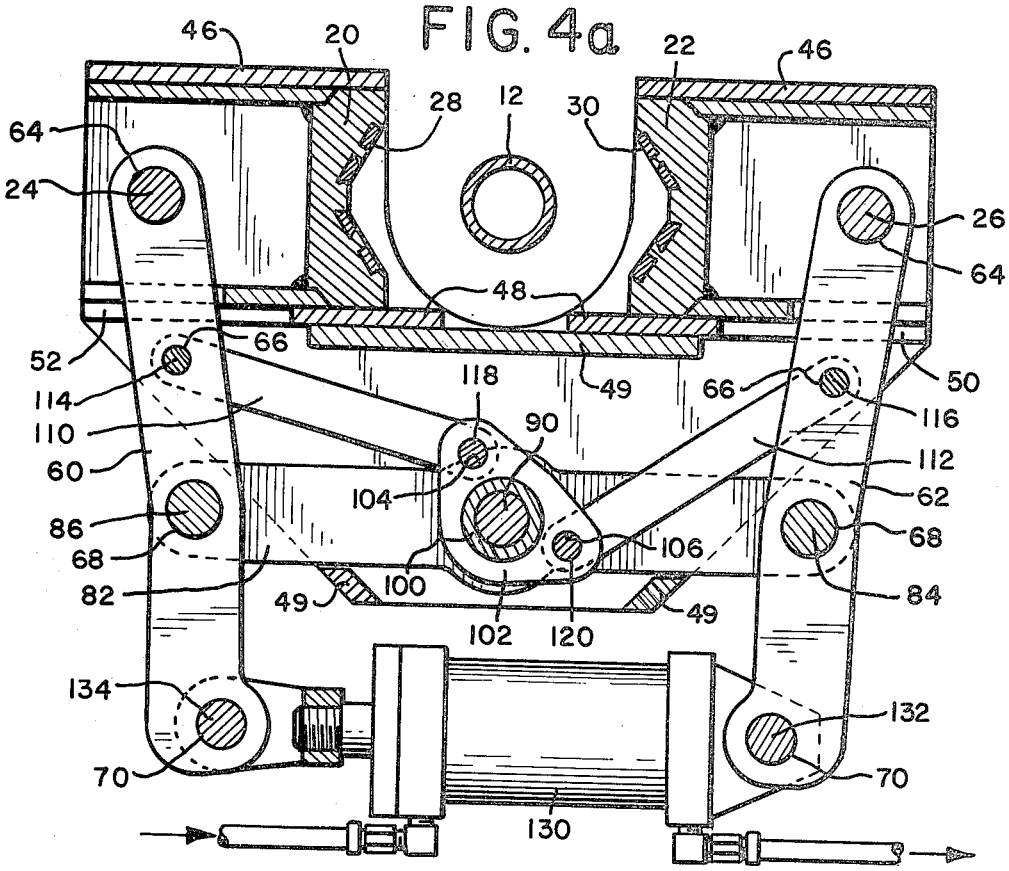
FIG. 4*a* is a cross-sectional view taken along line 4—4 of FIG. 3 showing the clamp in the open position with the jaws extended to the largest extent possible.

In this preferred embodiment, elongated slots 50,52 are formed in the edge plates 48, as best shown in FIG. 4*a*. In addition, a rounded oblong slot 92,94 is formed in each side plate 44,42, respectively. In this preferred embodiment, each of these oblong slots 92,94 measures 2.50 inches in width and 2.875 inches in length.

Mounted within the square guide channels formed by the frame 40 are two opposed clamping members or jaws 20,22. Each jaw 20,22 is substantially prevented from twisting by the respective portions of the frame 40, and is constrained to movement along a straight line such that each jaw 20,22 remains centered about a clamping axis which passes through the central, longitudinal axis of the down-hole tubular 12 being clamped. As used herein, the term "clamping axis" denotes the central longitudinal axis of the clamped down-hole tubular. Each jaw 20,22 defines a clamping surface 28,30 adjacent the front end of the jaw, and includes a pin 24,26 at the rear end of the jaw. Preferably, each clamping surface 28,30 is provided with four elongated hardened inserts which serve to securely grip down-hole tubulars clamped in the clamp 10.

Figure 2:
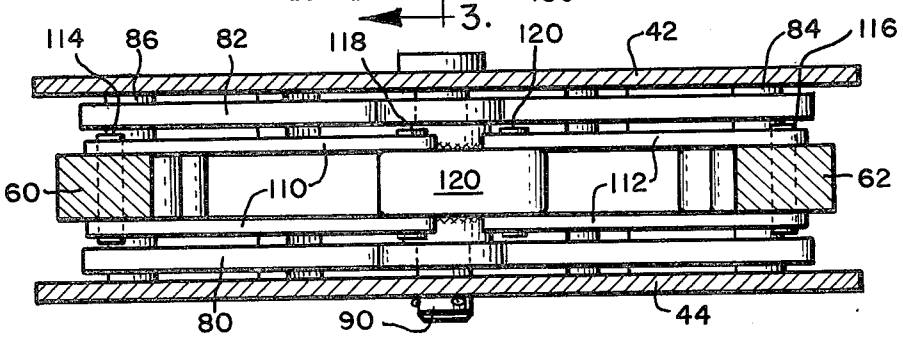
FIG. 2 is a cross-sectional view taken along the line 2—2 of FIG. 1.

As best shown in FIG. 4*a*, the clamp 10 also includes a pair of opposed rocker arms 60,62. Each rocker arm defines four separate holes spaced along the length of the rocker arm 60,62. In FIG. 4*a*, these four holes are designated by reference numerals 64, 66, 68 and 70. Each rocker arm 60,62 is pivotably connected to a respective one of the jaws 20,22 by means of the pin 24,26 which passes through the hole 64 in the respective rocker arm 60,62. Each rocker arm 60,62 is in turn pivotably mounted between a pair of spaced, parallel tension members 80,82 by means of pins 84,86. As best shown in FIGS. 2, 3 and 4*a*, these tension members 80,82 are in turn mounted to a pin 90 which is held in place in the oblong slots 92,94 formed in the frame 40. As will be explained below, the slots 92,94 allow a limited amount of longitudinal movement of the pin 90.

In this preferred embodiment the pin 90 is a solid steel pin 2.500 inches in diameter. Because of the close fit between the diameter of the pin 90 and the width of the oblong slots 92,94 along the length of the tension members 80,82 the pin 90 is substantially restrained from movement along the length of the tension members 80,82, yet it is permitted an excursion of approximately 0.375 inches along a line which passes through the center of the pin 90 and the clamped tubular member 12.

A sleeve 100 is pivotably mounted on the pin 90 between the tension members 80,82. In this preferred embodiment, a pivot plate 102 is secured to the sleeve 100 such that the two are free to pivot about the pin 90 as a unit. This pivot plate 102 defines two spaced attachment point bores 104,106. The pivot plate 102 is interconnected to each of the rocker arms 60,62 by means of links 110,112. As best shown in FIGS. 2 and 4*a*, a pair of parallel links 110 are pivotably mounted to the rocker arm 60 by means of a pin 114 which extends through the hole 66 in the rocker arm 60. In addition, these links 110 are pivotably secured to the pivot plate 102 via a pin 118 which passes through the bore 104 in the pivot plate 102. Similarly, a pair of parallel links 112 are mounted pivotably to the pivot plate 102 by means of a pin 120 which passes through the bore 106, and at the other end to the rocker arm 62 by means of a pin 116 which passes through the hole 66 in the rocker arm 62.

A hydraulic cylinder 130 is mounted between the rocker arms 60,62 by means of pins 132,134 which pass through the holes 70 in the end portions of the rocker arms 60,62. In this preferred embodiment, the links 110,112 and the tension members 80,82 are formed of $\frac{1}{2}$-inch plate steel, and the pivot plate 102 and the rocker arms 60,62 are formed of $1\frac{1}{2}$-inch plate steel.

Figure 4B:
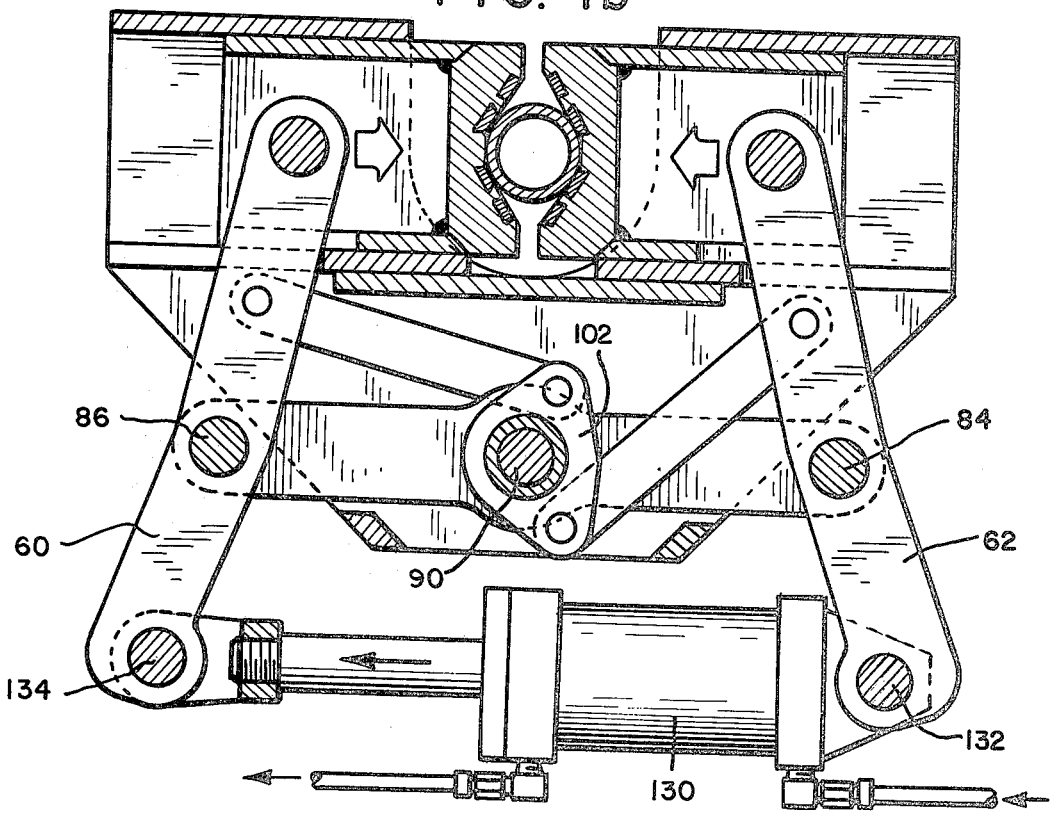
FIG. 4*b* is a cross-sectional view corresponding to that of FIG. 4*a* showing the clamp in a closed position.

Having described the structure of this preferred embodiment of the clamp of this invention, its operation can now be discussed in connection with FIGS. 4*a* and 4*b*. FIG. 4*a* shows the clamp 10 with the jaws 20,22 retracted to permit large diameter down-hole tubulars to be loaded into the clamp 10. FIG. 4*b* shows the same clamp with the jaws 20,22 moved towards one another to clamp a small diameter down-hole tubular. As can be seen by comparing FIGS. 4*a* and 4*b*, the hydraulic cylinder 130 acts to pivot the rocker arms 60,62 about the pins 86,84, and thereby to position the jaws 20,22. As explained above, the frame 40 acts as a guide to restrict movement of the jaws 20,22 to linear movement such that the center line of the jaws remains centered on the desired clamping axis for the tubular 12.

The elongation of the slots 92,94 allows the tension members 80,82 to approach the jaws 20,22 when the jaws are positioned close to one another, while also allowing the tension members 80,82 to move away from the jaws 20,22 when the jaws are moved away from each other. This movement of the pin 90 and the tension members 80,82 is important, for it allows the clamping loads to be transferred symmetrically from the jaws 20,22 to the rocker arms 60,62 while allowing the jaws 20,22 to move in precisely a straight line. In effect, the elongation of the slots 92,94 accomodates the varying separation between the tension members 80,82 and the jaws 20,22 caused by the varying angle of the rocker arms 60,62.

The links 110,112 and the pivot plate 102 serve to center the jaws 20,22 simply and reliably on the desired clamping axis. When the jaws 20,22 move from the open position shown in FIG. 4*a* to the closed position shown in FIG. 4*b*, the links 110,112 serve to rotate the pivot plate 102 from the position shown in FIG. 4*a* to the position shown in FIG. 4*b*. As the pivot plate 102 rotates about the pin 90, it insures that the rocker arms 60,62 maintain substantially symmetrical positions with respect to the desired clamping axis. This insures that the jaws 20,22 are symmetrically placed about the desired clamping axis throughout the range of travel of the jaws 20,22. Thus, the clamp 10 centers the jaws 20,22 with the required precision about the desired clamping axis for a wide range of travel of the jaws 20,22. This means that both large diameter down-hole tubulars and small diameter down-hole tubulars can be reliably clamped about the same clamping axis, automatically and without the need for manual adjustment or replacement of component parts of the clamp 10. The preferred embodiment shown in the drawings reliably and automatically centers clamped tubulars having diameters as large as 9½ inches and as small as 3½ inches substantially about the same clamping axis.

One important advantage of the self-centering clamp of this invention is that it can be embodied in a compact, rigid clamp which is relatively low in cost and easy to manufacture. The clamp of this invention can be used in many applications related to the handling of down-hole tubulars. For example, a pair of spaced clamps 10 can be mounted to a drill rig transfer arm to clamp down-hole tubulars as they are moved between a horizontal and a vertical position with the arm. These clamps can be used to releasably clamp down-hole tubulars having wide range diameters to the transfer arm. Because each clamped tubular is centered about substantially the same clamping axis, the clamp of this invention allows tubulars to be precisely centered with other tubulars, as when necessary to make up a drill string, for example.

A second important application for the self-centering clamp of this invention is in make-up or break-out devices used to make and break threaded joints between adjacent lengths of down-hole tubulars. Because the clamp of this invention is self-centering for a wide range of clamped tubulars, make-up or break-out devices utilizing this clamp can be used with a wide range of tubulars without need for any adjustment to provide for proper centering of the clamp.

An additional advantage of this preferred embodiment is that it is simple and rugged, and well suited to bear the heavy loads to which such clamps are routinely subjected. The novel linkage of this embodiment is compact in that none of the linkage extends beyond the hydraulic cylinder. Furthermore, this embodiment is easily manufactured from readily worked materials such as plate steel. The link and pivot plate arrangement is reliable, and it entirely avoids the need for a gear linkage.

Of course, it should be understood that various changes and modifications to the preferred embodiment described above will be apparent to those skilled in the art. For example, the clamp of this invention can be scaled as appropriate to accomodate tubulars of the desired sizes and to bear associated stresses and strains reliably. Such changes and modifications can be made without departing from the true spirit and scope of the present invention, and it is therefore intended that the following claims be interpreted to cover all such changes and modifications.

We claim:

1. A self centering clamp for clamping down-hole tubulars having a range of diameters about a substantially predetermined clamping axis, said clamp comprising:

a pair of opposed clamping jaws;

means for guiding the jaws to move along a first line which passes through the clamping axis;

means for positioning the opposed jaws along the first line, said positioning means comprising a pivot member having first and second spaced attachment points, means for rotatably mounting the pivot member to the clamp, means for connecting the first jaw to the first attachment point such that movement of the first jaw along the first line causes the pivot member to rotate, and means for connecting the second jaw to the second attachment point such that rotation of the pivot member causes the second jaw to move along the first line to maintain the first and second jaws substantially equidistant from the clamping axis.

2. The clamp of claim 1 wherein the clamp further comprises a frame having first and second side plates.

3. The clamp of claim 1 wherein the means for connecting the first jaw to the first attachment point includes a first rocker arm coupled to the first jaw and a first link member coupled between the first rocker arm and the first attachment point.

4. The clamp of claim 3 wherein the means for connecting the second jaw to the second attachment point includes a second rocker arm coupled to the second jaw and a second link member coupled between the second rocker arm and the second attachment point.

5. The clamp of claim 4 wherein the positioning means further comprises means for pivotably mounting each of the first and second rocker arms to the clamp and a hydraulic cylinder mounted between the first and second rocker arms.

6. A self-centering clamp for clamping down-hole tubulars having a range of diameters about a substantially predetermined clamping axis, said clamp comprising:

a pair of opposed jaws;

means for guiding the jaws to move along a first line which passes through the clamping axis;

first and second opposed rocker arms, each of which is coupled to a respective jaw;

means for pivotably mounting each of the opposed rocker arms to the clamp;

means for pivoting the opposed rocker arms about the rocker arm mounting means to control the separation of the jaws;

means for interconnecting the opposed rocker arms to maintain the jaws substantially equidistant from the clamping axis, said interconnecting means comprising a pivot member having first and second spaced attachment points, a first link member mounted between the first attachment point and the first rocker arm, a second link member mounted between the second attachment point and the second rocker arm, and means for pivotably mounting the pivot member to the clamp such that pivoting of either one of the opposed rocker arms causes the pivot member to rotate and the link members to position the other of the opposed rocker arms such that the jaws are disposed substantially symmetrically about the clamping axis.

7. The clamp of claim 6 wherein the means for pivoting the opposed rocker arms comprises a hydraulic cylinder mounted between the opposed rocker arms.

8. The clamp of claim 6 wherein the means for mounting the opposed rocker arms comprises a cross brace mounted between the opposed rocker arms, and wherein the clamp further comprises a frame and means for mounting the cross brace to the frame such that the cross brace is guided along a second line which passes through the clamping axis and is substantially perpendicular to the first line, and further wherein the means for guiding the jaws is rigidly mounted to the frame.

9. The clamp of claim 8 wherein the means for mounting the pivot member mounts the pivot member to the cross brace.

10. A self-centering clamp for clamping down-hole tubulars having a range of diameters about a substantially predetermined clamping axis, said clamp comprising:

a frame;

a pair of opposed clamping jaws;

means, included in the frame, for guiding the jaws to move along a first line which passes through the clamping axis;

first and second opposed rocker arms, each rocker arm having a first end coupled to a respective one of the jaws and a second end;

a tension member having two spaced pivot sections, each pivot section mounted to a respective one of the opposed rocker arms such that each rocker arm is pivotable about the respective pivot section;

means for mounting the tension member to the frame such that the tension member is movable along a second line which passes through the clamping axis and is substantially perpendicular to the first line;

a hydraulic cylinder mounted between the second ends of the opposed rocker arms such that extension of the hydraulic cylinder pivots the rocker arms about the respective pivot sections of the tension member and moves the jaws along the first line;

a pivot member defining first and second spaced attachment points;

means for pivotably mounting the pivot member to the tension member;

a first link member mounted at one end to the first rocker arm and at the other end to the first attachment point of the pivot member such that pivoting movement of the first rocker arm about the tension member causes the pivot member to pivot with respect to the tension member;

a second link member mounted at one end to the second rocker arm and at the other end to the second attachment point of the pivot member such that pivoting movement of the pivot member with respect to the tension member causes the second rocker arm to pivot about the tension member;

the lengths of said first and second link members chosen such that the jaws remain substantially equidistant from the clamping axis as the rocker arms are positioned by the hydraulic cylinder.

11. The clamp of claim 10 wherein the means for mounting the tension member to the frame comprises opposed portions of the frame which define opposed elongated slots and a pin which passes through the tension member and fits within the opposed slots, said slots having a width measured along a line parallel to the first line substantially equal to the width of the pin and a length measured along a line parallel to the second line greater than the length of the pin.

12. The clamp of claim 10 wherein each of said slots is symmetrically disposed about the second line.

13. The clamp of claim 10 wherein the means for guiding the jaws includes a pair of opposed, co-linear rectangular channels defined by the frame, each channel sized to receive and guide a respective one of the opposed jaws.

14. A self-centering clamp for clamping down-hole tubulars having a range of diameters about a substantially predetermined clamping axis, said clamp comprising:

first and second spaced, substantially parallel side plates, each plate defining an elongated slot therein having a longitudinal axis;

a plurality of edge plates rigidly mounted between the side plates such that the edge plates in combination with the side plates define a pair of aligned guide cavities therebetween oriented along a first line passing through the clamping axis;

a pair of opposed clamping jaws, each jaw disposed in a respective one of the guide cavities such that the jaws are guided to move along the first line;

a pin disposed between the side plates in the elongated slots, said pin sized such that the pin is movable along the longitudinal axis of the slots but is substantially prevented from moving transverse to the longitudinal axis of the slots;

at least one tension member mounted on the pin between the side plates, said tension member defining opposed pivot sections at the ends thereof;

a pivot plate mounted on the pin to rotate with respect to the side plates, said pivot plate defining a pair of spaced attachment points;

first and second opposed rocker arms, each rocker arm pivotably mounted to a respective one of the pivot sections of the tension member, and each rocker arm mounted to a respective one of the jaws;

a hydraulic cylinder mounted between the opposed rocker arms such that extension of the cylinder pivots the rocker arms about the respective pivot sections of the tension member, thereby causing the opposed jaws to move along the first line;

a first link member mounted between the first rocker arm and the first attachment point such that pivotal movement of the first rocker arm causes the pivot plate to rotate;

a second link member mounted between the second rocker arm and the second attachment point such that rotation of the pivot plate causes the second rocker arm to pivot;

the length of the first and second link members being chosen such that the opposed jaws remain substantially equidistant from the clamping axis as the jaws move along the first line;

the longitudinal axis of each elongated slot oriented to intersect the clamping axis.

* * * * *